US008440962B2

(12) United States Patent
Le Blanc

(10) Patent No.: US 8,440,962 B2
(45) Date of Patent: May 14, 2013

(54) TARGETED ION PARKING FOR QUANTITATION

(75) Inventor: Yves Le Blanc, Newmarket (CA)

(73) Assignee: DH Technologies Development Pte. Ltd., Singapore (SG)

( * ) Notice: Subject to any disclaimer, the term of this patent is extended or adjusted under 35 U.S.C. 154(b) by 278 days.

(21) Appl. No.: 12/555,604

(22) Filed: Sep. 8, 2009

(65) Prior Publication Data

US 2011/0057098 A1 Mar. 10, 2011

(51) Int. Cl.
*H01J 49/06* (2006.01)
*H01J 49/26* (2006.01)

(52) U.S. Cl.
USPC ..... 250/283; 250/282; 250/304

(58) Field of Classification Search ..... 250/281–284, 250/293, 304
See application file for complete search history.

(56) References Cited

U.S. PATENT DOCUMENTS

| | | | | |
|---|---|---|---|---|
| 4,849,628 | A * | 7/1989 | McLuckey et al. | 250/282 |
| 5,710,713 | A * | 1/1998 | Wright et al. | 250/282 |
| 6,627,875 | B2 | 9/2003 | Afeyan et al. | |
| 6,744,043 | B2 | 6/2004 | Loboda | |
| 7,060,972 | B2 * | 6/2006 | Hager | 250/283 |
| 7,077,944 | B2 * | 7/2006 | Clemmer | 205/282 |
| 7,550,718 | B2 * | 6/2009 | McLuckey et al. | 250/282 |
| 7,577,538 | B2 * | 8/2009 | Wang | 702/85 |
| 7,622,712 | B2 * | 11/2009 | Hager | 250/283 |
| 7,700,912 | B2 * | 4/2010 | Amster et al. | 250/282 |
| 7,749,769 | B2 * | 7/2010 | Hunt et al. | 436/173 |
| 7,829,851 | B2 * | 11/2010 | McLuckey et al. | 250/292 |
| 7,842,917 | B2 * | 11/2010 | McLuckey et al. | 250/283 |
| 8,080,783 | B2 * | 12/2011 | Whitehouse et al. | 250/288 |
| 2002/0166958 | A1 * | 11/2002 | Afeyan et al. | 250/282 |
| 2004/0094702 | A1 * | 5/2004 | Clemmer | 250/283 |
| 2005/0199804 | A1 * | 9/2005 | Hunt et al. | 250/290 |
| 2006/0219898 | A1 * | 10/2006 | McLuckey et al. | 250/288 |
| 2006/0255258 | A1 * | 11/2006 | Wang et al. | 250/282 |
| 2007/0015158 | A1 * | 1/2007 | McLuckey et al. | 250/282 |
| 2007/0228272 | A1 * | 10/2007 | Loboda | 250/293 |
| 2007/0284519 | A1 * | 12/2007 | Rockwood et al. | 250/282 |
| 2008/0044915 | A1 * | 2/2008 | Hunt et al. | 436/89 |
| 2008/0050833 | A1 * | 2/2008 | Smith et al. | 436/86 |
| 2008/0116366 | A1 * | 5/2008 | Shiea et al. | 250/282 |
| 2008/0128610 | A1 * | 6/2008 | McLuckey et al. | 250/283 |
| 2008/0128611 | A1 * | 6/2008 | McLuckey et al. | 250/283 |
| 2009/0230302 | A1 * | 9/2009 | Hunt et al. | 250/282 |
| 2009/0256073 | A1 * | 10/2009 | Guo et al. | 250/288 |
| 2010/0084548 | A1 * | 4/2010 | Mcluckey et al. | 250/283 |

(Continued)

*Primary Examiner* — David A Vanore
*Assistant Examiner* — Wyatt Stoffa
(74) *Attorney, Agent, or Firm* — John R. Kasha; Kasha Law LLC

(57) ABSTRACT

A plurality of targeted ion characteristics and a charge reduction amount are received. A subset of ionized molecules of a sample corresponding to each characteristic of the plurality of targeted ion characteristics is transmitted from a first location to a second location, producing a plurality of selected ionized molecules. Reagent ions are transmitted to the second location to reduce the charge state of the selected ionized molecules. The charge state reduction of the selected ionized molecules is stopped at the charge state reduction amount, producing a plurality of parked targeted ions in the second location. The targeted ion characteristics can include mobilities or mass-to-charge ratios. Quantitation information for an analyte can be obtained by performing targeted ion parking on a plurality of standards, developing a calibration function, performing targeted ion parking on a sample and using the calibration function to determine the concentration of the analyte in the sample.

11 Claims, 15 Drawing Sheets

U.S. PATENT DOCUMENTS

2010/0276585 A1* 11/2010 Lehmann et al. ..... 250/282
2010/0314537 A1* 12/2010 McLuckey et al. ..... 250/282
2011/0049360 A1* 3/2011 Schoen ..... 250/290
2011/0057098 A1* 3/2011 Le Blanc ..... 250/283
2011/0114835 A1* 5/2011 Chen et al. ..... 250/282
2011/0118136 A1* 5/2011 Koster et al. ..... 506/9

* cited by examiner

TARGETED ION PARKING FOR QUANTITATION

Electrospray ionization (ESI) and other ionization methods can produce multiply-charged analyte ions from large molecules including peptides and proteins. This permits certain analysis of high mass molecules by a mass spectrometer having a lower mass-to-charge range. It is also known that introducing counter ions of opposite charge, including singly-charged counter ions, which can react by ion to ion charge transfer reactions, including proton transfer reactions, will migrate the analyte ions to lesser multiple charged states that represent higher mass-to-charge ratios. Ion parking is a method of controlling the ion to ion transfer reactions for practical use in mass spectrometry. Conventionally, ion parking involves inhibiting the rate of ion to ion transfer reactions in a selective fashion such that particular ions are preferentially retained or accumulated, while ions that are not selected can undergo unperturbed reactions up to neutralization.

DRAWINGS

The skilled person in the art will understand that the drawings, described below, are for illustration purposes only. The drawings are not intended to limit the scope of the applicant's teachings in any way.

Figure 1:
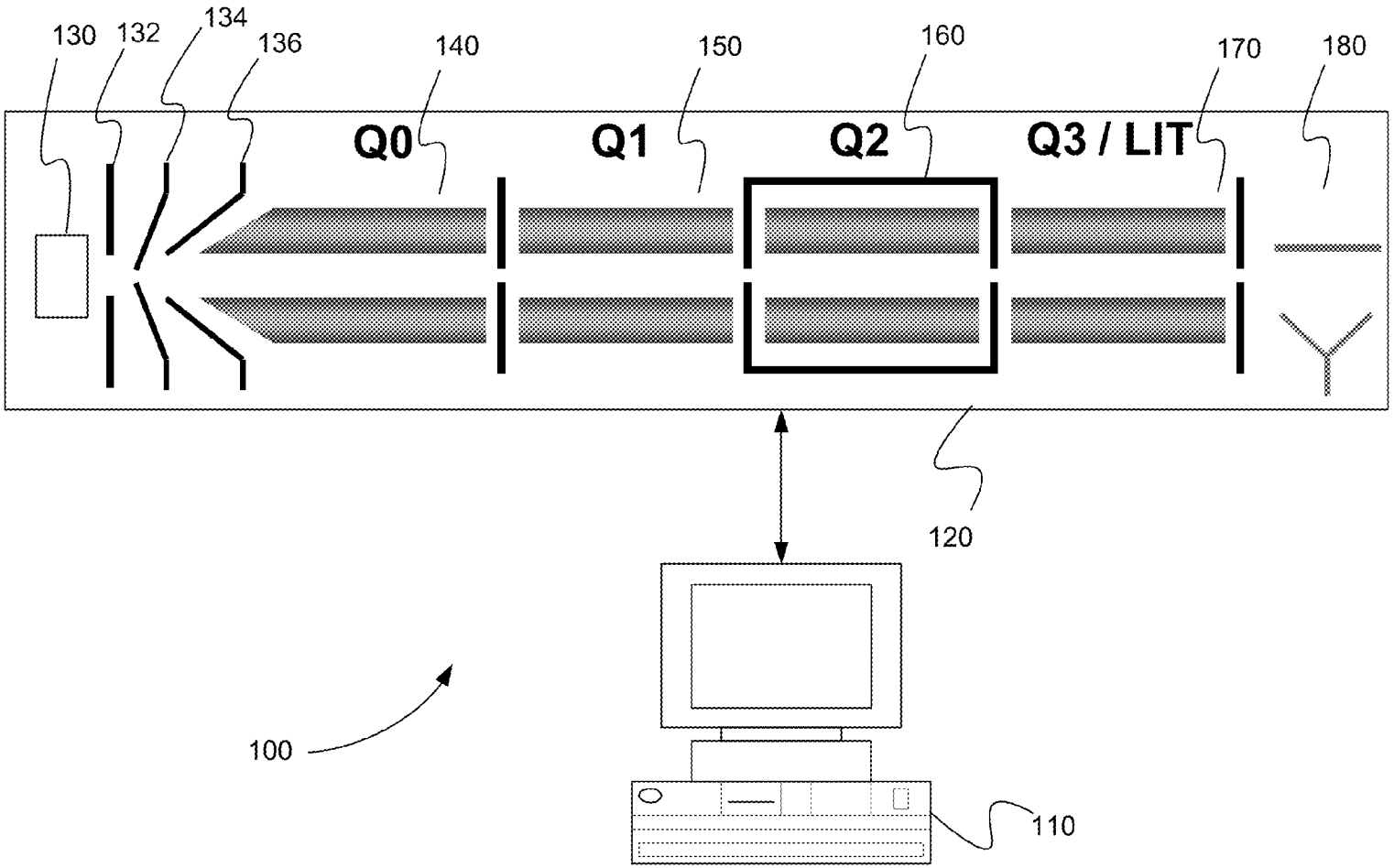
FIG. 1 is a schematic diagram that illustrates a system for targeted ion parking that includes a hybrid quadrupole linear ion trap system (QqQLIT), upon which embodiments of the present teachings may be implemented.

Before one or more embodiments of the invention are described in detail, one skilled in the art will appreciate that the invention is not limited in its application to the details of construction, the arrangements of components, and the arrangement of steps set forth in the following detailed description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF VARIOUS EMBODIMENTS

The section headings used herein are for organizational purposes only and are not to be construed as limiting the subject matter described in any way.

Methods of Data Processing

Ion Parking

U.S. Pat. No. 6,627,875 to Afeyan et. al. (the "Afeyan patent") discloses a method of ion parking using a three-dimensional ion trap. In this method, a tailored waveform is applied to the endcap electrodes of the three-dimensional ion trap to segregate a subset of ionized molecules from sample molecules. Reagent ions are reacted with the subset of ionized molecules to reduce the charge state of the subset of ionized molecules. Reduced ionized molecules having the highest mass-to-charge ratio are detected. These steps are then repeated in the same physical space, chamber, or location for another tailored waveform until a mass spectrum is defined.

One disadvantage of performing ion parking in the same physical space, chamber, or location is decreased selectivity. All molecules within the subset of ionized molecules are charge reduced together. As a result, noise or species in between masses of interest are parked along with the masses of interest reducing selectivity.

In various embodiments, systems and methods perform ion parking on a "selective subset" of the plurality of ions generated from an ion source. Therefore, ions predominantly corresponding to the compound of interest are selected prior to ion parking. The ions corresponding to the compound of interest can be selected based on a number of ion characteristics. One ion characteristic is mass. In mass based selection a mass analyzer is used to select the ions of interest prior to ion parking. A mass analyzer can include, but is not limited to, a quadrupole or a trap.

Another ion characteristic that can be used for the selection is mobility. In mobility based selection a mobility cell is used to select the ions of interest prior to ion parking. Multiply charged ions have been shown to have mobilities that can be significantly different between species. Multiply charged ions can include, but are not limited to, proteins or peptides. A mobility cell can include, but is not limited to, a low field mobility cell, a differential mobility analyzer (DMA), a differential mobility spectrometry (DMS) cell, or a field asymmetric waveform ion mobility spectrometry (FAIMS) cell.

FIG. 1 is a schematic diagram that illustrates a system 100 for targeted ion parking that includes a hybrid quadrupole linear ion trap system (QqQLIT), upon which embodiments of the present teachings may be implemented. System 100 includes processor 110 and mass spectrometer 120. Processor 110 is in two-way communication with mass spectrometer 120. Processor 110 can be, but is not limited to, a computer, microprocessor, or any device capable of sending and receiving data and control signals to and from mass spectrometer 120 and processing information.

Processor 110 receives a group of mass-to-charge ratios to be targeted or isolated. Processor 110 also receives a charge state reduction amount. Processor 110 receives these values from a user, for example. The charge state reduction amount is the number of charges (z) by which the targeted ionized molecules of the sample will be reduced, consequently increasing the observed m/z (mass to charge ratio) associated with the ionized molecule of the sample. In other words, the charge state reduction amount is the level at which the charge reduction reaction will be stopped.

Under the control of processor 110, mass spectrometer 120 performs targeted ion parking based on ion mass. The ionized molecules of the sample are created by ionization device 130 of mass spectrometer 120. The ionized molecules pass through curtain plate 132, orifice 134, and skimmer 136 to reach quadrupole 140. Quadrupole 140 is used to focus the ionized molecules. Quadrupole 150 selects and transmits a subset of ionized molecules of the sample corresponding to each of the mass-to-charge ratios received by processor 110 from quadrupole 150 to quadrupole 160. Quadrupole 150 can be, for example, a quadrupole ion guide or mass filter. Quadrupole 160 is, for example, a collision cell. Processor 110, for example, can be used to vary the radio frequency direct current (RFDC) voltage applied to quadrupole 150 to transmit sequentially each subset of ionized molecules of the sample corresponding to each of the mass-to-charge ratios to be targeted.

Each subset of ionized molecules of the sample transmitted by quadrupole 150 is accumulated in quadrupole 160. Reagent ions are transmitted into quadrupole 160 to charge reduce the accumulated ionized molecules. The charge reduction reaction in quadrupole 160 is stopped at the charge state reduction amount, producing a plurality of parked targeted ions in quadrupole 160. As a result, in system 100 the ionized molecules are mass selected and parked in separate locations, quadrupole 150 and quadrupole 160, respectively.

Charge reduction is stopped for the compound of interest by inhibition of the reaction. This is done, for example, by resonant excitation at an m/z associated with the compound of interest. Here z represents the reduced charge for the compound of interest. Because z has a lower value after the reduction and m (mass) is constant for a given compound, parking occurs at a higher m/z value. Other ions continued to react until they are moved to the next stage of analysis. In other words, the reaction proceeds for finite amount of time. Typically, the allowed reaction time is set to a few tens of milliseconds. After that time period, all ions are transferred to a mass analysis section, for example, and reagent ions move in a direction opposite to the direction of ions of the compound of interest.

Quadrupole 160 is the preferred location for charge reduction and ion parking, because performing these operations at higher pressure can improve efficiency and speed. Typically, quadrupole 140 and 160 have much higher pressures than quadrupole 150 and chamber 170, for example. The pressures in quadrupole 140 and 160 are on the order of 1-10 milli-Torr, for example. The pressures in quadrupole 150 and chamber 170 are on the order of 10-100 micro-Torr, for example.

The reagent ions follow a similar path as the ionized molecules of the sample to quadrupole 160. The reagent ions are, for example, transmitted by quadrupole 150 to quadrupole 160. The targeted ions and reagent ions are introduced sequentially, for example.

After the targeted ions are charged reduced and parked, they are transferred from quadrupole 160 to quadrupole 170 for additional ion processing. Additional ion processing can include, but is not limited to, mass analysis or fragmentation.

In various alternative embodiments, quadrupole 150 selects and transmits a subset of the sample of ionized molecules corresponding to each of the mass-to-charge ratios received by processor 110 from quadrupole 150 through quadrupole 160 to chamber 170. Each subset of ionized molecules of the sample transmitted by quadrupole 150 is accumulated in chamber 170. Reagent ions are transmitted into quadrupole 170 to charge reduce the accumulated ionized molecules. The charge reduction in chamber 170 is stopped at the charge state reduction amount, producing a plurality of parked targeted ions chamber 170. As a result, in this embodiment the ionized molecules are mass selected by quadrupole 150 and parked in ion chamber 170.

Chamber 170 can be used to determine a mass spectrum from the reduced ionized molecules accumulated in quadrupole 160 or chamber 170. Chamber 170 can be, but is not limited to, a quadrupole, an ion trap, or a linear ion trap mass spectrometer, for example. Detector 180 is used to detect the parked target ions, for example.

Figure 2:
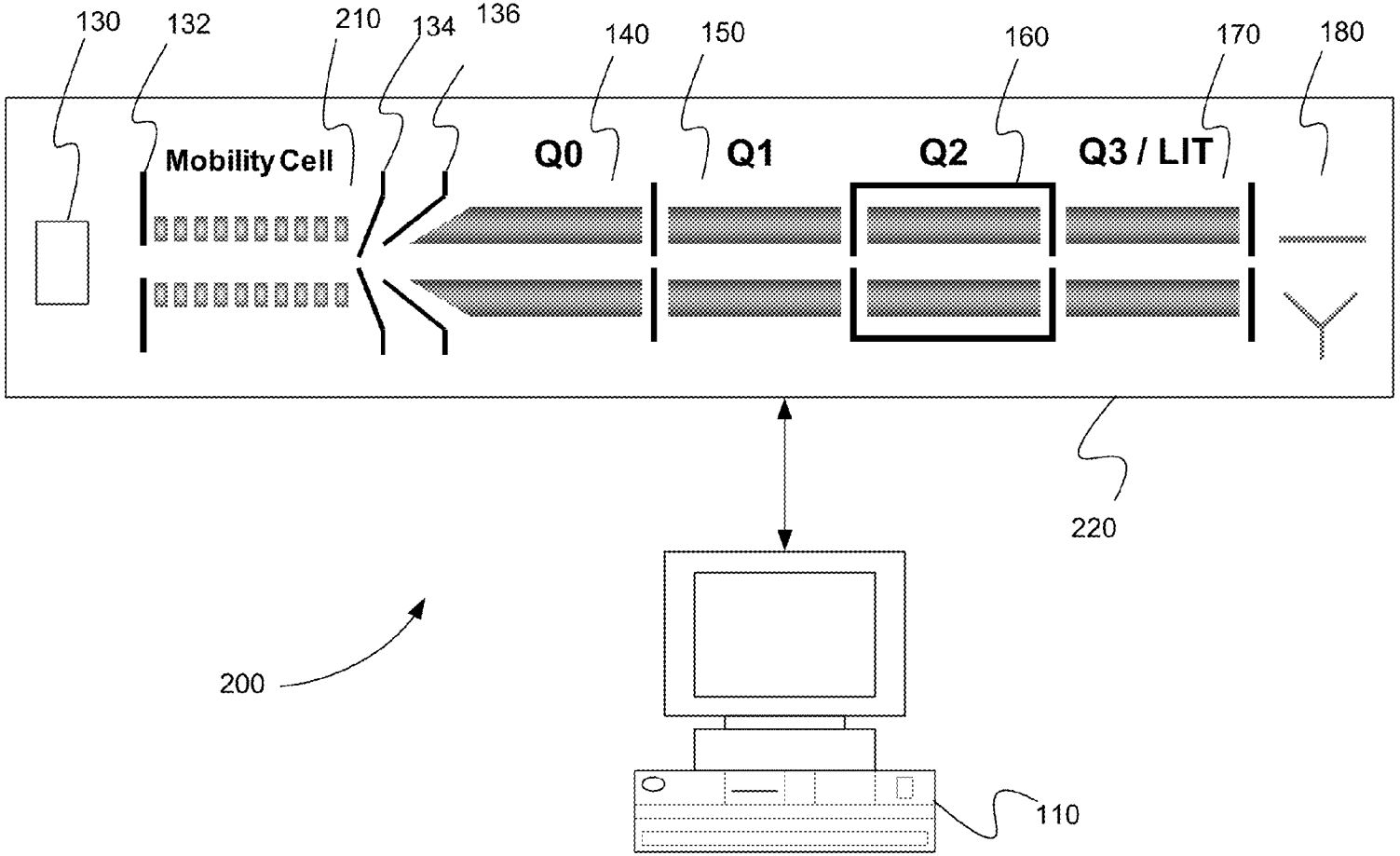
FIG. 2 is a schematic diagram that illustrates a system for targeted ion parking that includes a mobility cell and a hybrid quadrupole linear ion trap (QqQLIT) system, upon which embodiments of the present teachings may be implemented.

FIG. 2 is a schematic diagram that illustrates a system 200 for targeted ion parking that includes a mobility cell and a hybrid quadrupole linear ion trap system (QqQLIT), upon which embodiments of the present teachings may be implemented.

System 200 includes processor 110 and mass spectrometer 220. Processor 110 receives a group of ion mobilities to be targeted or isolated. Processor 110 also receives a charge state reduction amount.

Under the control of processor 110, mass spectrometer 220 performs targeted ion parking based on ion mobility. The ionized molecules of the sample are created by ionization device 130 of mass spectrometer 220. The ionized molecules pass through curtain plate 132 and into mobility cell 210. Mobility cell 210 is used to select a subset of ionized molecules of the sample corresponding to each of the ion mobilities received by processor 110. Mobility cell 210 is located before orifice 134 and is not under vacuum. As a result, the selection of the subset of ionized molecules based on ion mobility is at atmospheric pressure. Placing mobility cell 210 before vacuum chambers can increase its efficiency.

The subset of mobility selected ionized molecules pass through orifice 134 and skimmer 136 to reach quadrupole 140. Quadrupole 140 is used to focus the ionized molecules. Quadrupole 150 transmits the subset of ionized molecules from quadrupole 150 to quadrupole 160. For example, processor 110 operates quadrupole 150 in radio frequency (RF) mode only, so no mass selection is performed by quadrupole 150. Each subset of ionized molecules of the sample transmitted by quadrupole 150 is accumulated in quadrupole 160. Reagent ions are transmitted into quadrupole 160 to charge reduce the accumulated ionized molecules. The charge reduction in quadrupole 160 is stopped at the charge state reduction amount, producing a plurality of parked targeted ions in quadrupole 160. As a result, in system 200 the ionized molecules are mobility selected and parked in separate locations, mobility cell 210 and quadrupole 160, respectively.

After the targeted ions are charged reduced and parked, they are transferred from quadrupole 160 to quadrupole 170 for additional ion processing. Additional ion processing can include, but is not limited to, mass analysis or fragmentation.

In various embodiments and as described above, charge reduction and ion parking can also occur in chamber 170. In these embodiments the ionized molecules are mobility selected in mobility cell 210 and parked in chamber 170.

In various embodiments, system 200 is used to perform targeted ion parking based on both ion mass and ion mobility. Processor 110 receives a group of ion mobilities and a group of mass-to-charge ratios to be targeted or isolated. Processor 110 also receives a charge state reduction amount.

Under the control of processor 110, mass spectrometer 220 performs targeted ion parking based on ion mobility and ion mass. The ionized molecules of the sample are created by ionization device 130 of mass spectrometer 220. The ionized molecules pass through curtain plate 132 and into mobility cell 210. Mobility cell 210 is used to select a subset of ionized molecules of the sample corresponding to each of the ion mobilities received by processor 110.

The subset of mobility selected ionized molecules pass through orifice 134 and skimmer 136 to reach quadrupole 140. Quadrupole 140 is used to focus the ionized molecules. Quadrupole 150 selects and transmits a subset of the mobility selected ionized molecules corresponding to each of the mass-to-charge ratios received by processor 110 from quadrupole 150 to quadrupole 160. Each subset of ionized molecules transmitted by quadrupole 150 is accumulated in quadrupole 160. Reagent ions are transmitted into quadrupole 160 to charge reduce the accumulated ionized molecules. The charge reduction in quadrupole 160 is stopped at the charge state reduction amount, producing a plurality of parked targeted ions in quadrupole 160. As a result, in this embodiment of system 200 the ionized molecules are mobility selected, mass selected, and parked in separate locations, mobility cell 210, quadrupole 150, and quadrupole 160, respectively.

Figure 3:
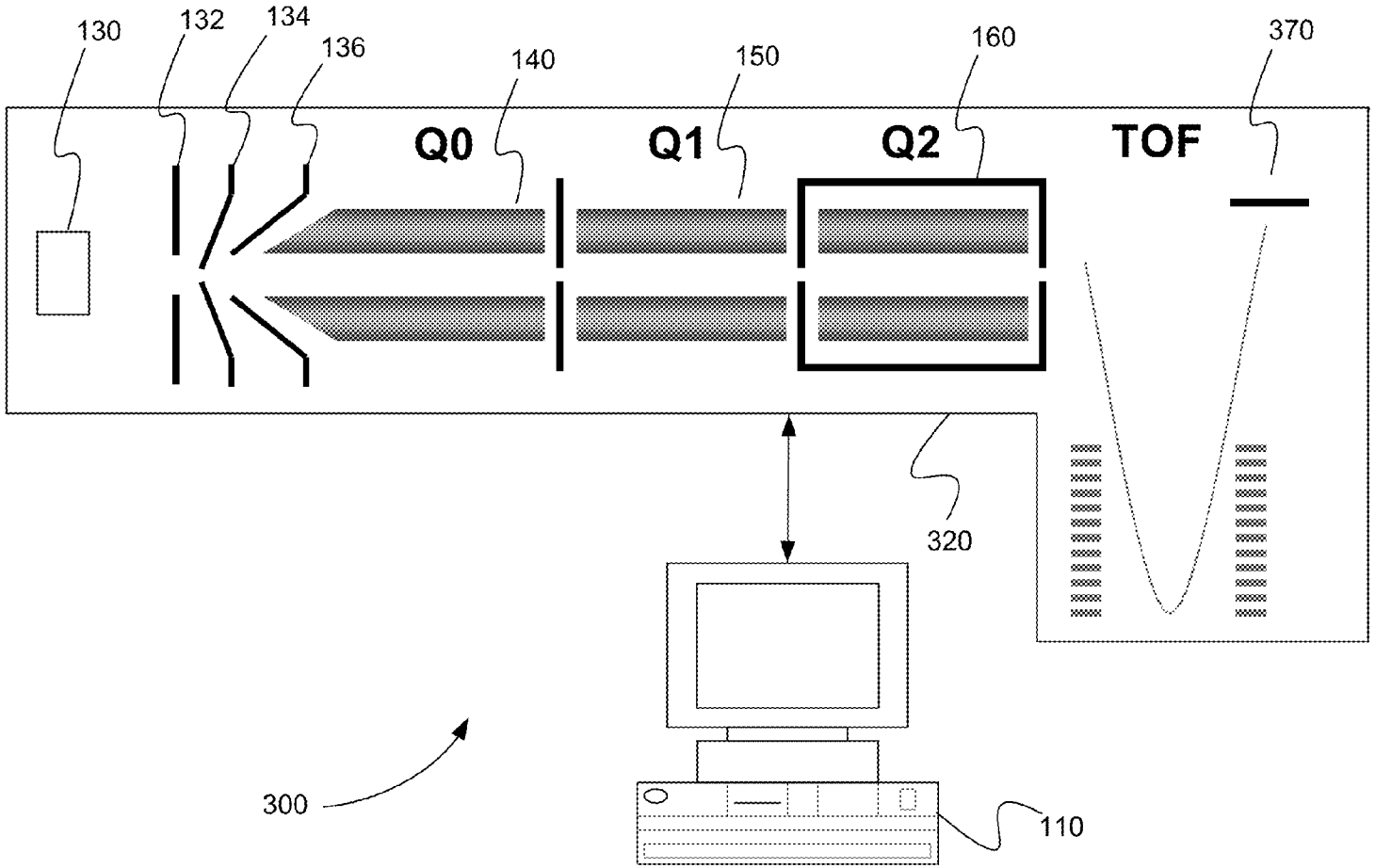
FIG. 3 is a schematic diagram that illustrates a system for targeted ion parking that includes a hybrid quadrupole time-of-flight (QqTOF) system, upon which embodiments of the present teachings may be implemented.
Figure 4:
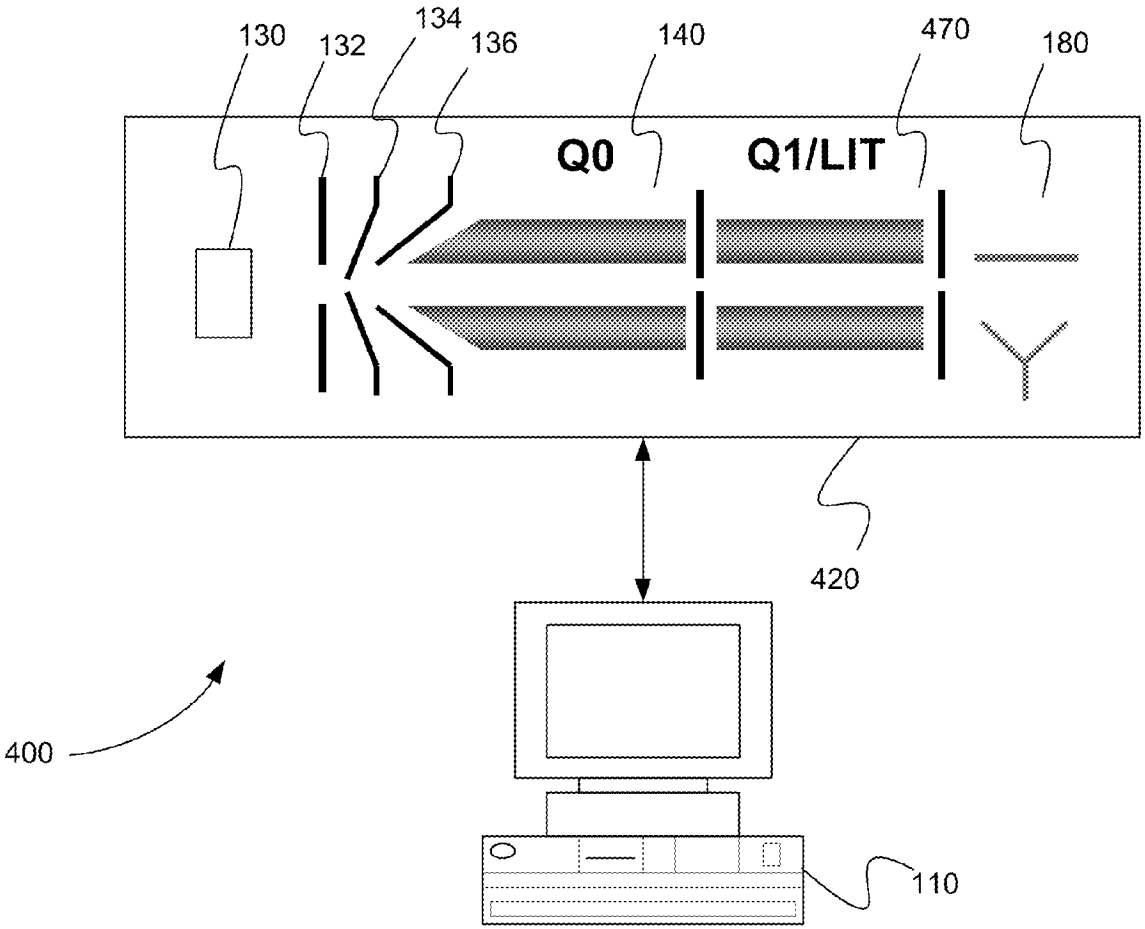
FIG. 4 is a schematic diagram that illustrates a system for targeted ion parking that includes a quadrupole linear ion trap (QLIT) system, upon which embodiments of the present teachings may be implemented.
Figure 5:
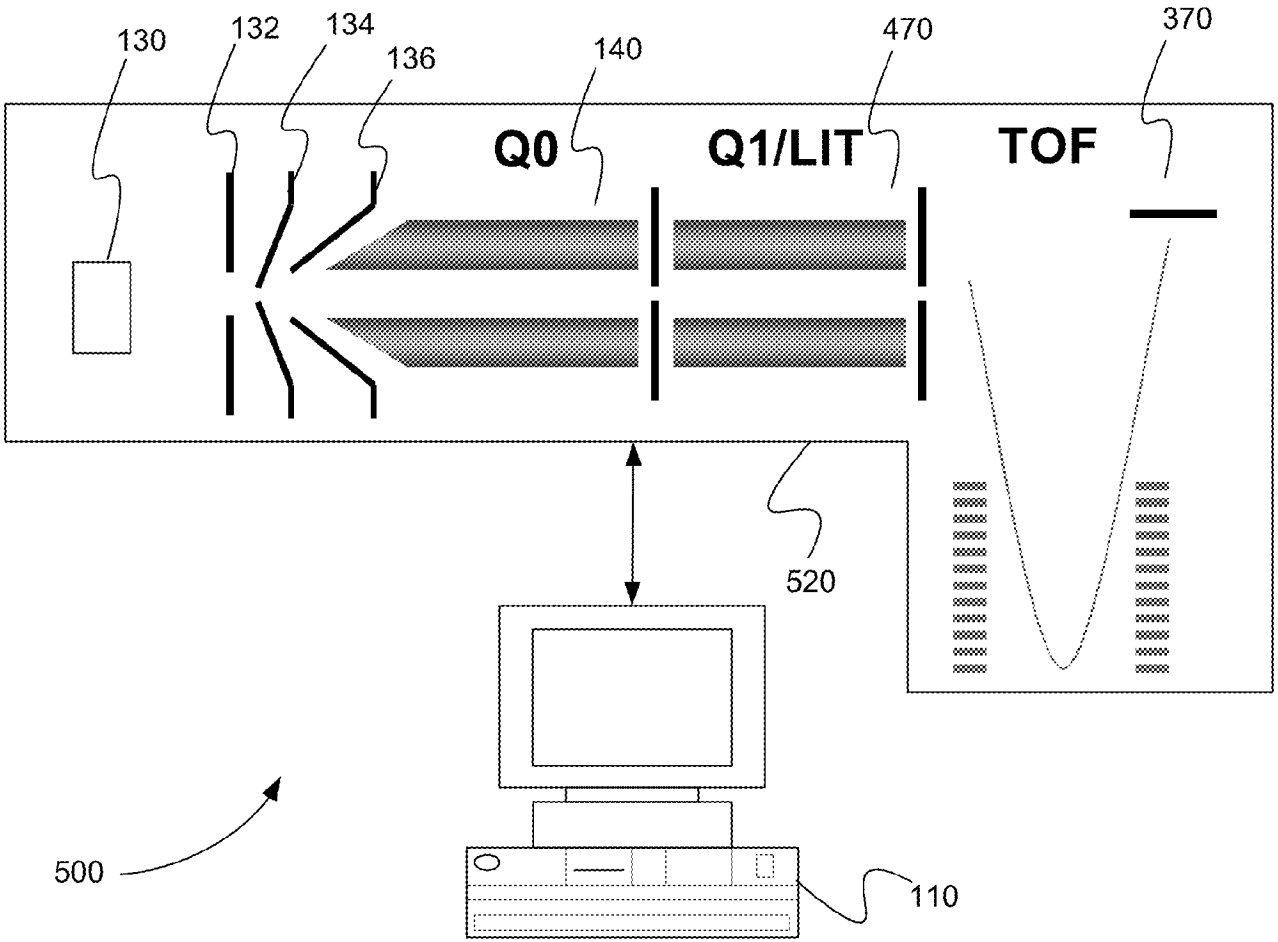
FIG. 5 is a schematic diagram that illustrates a system for targeted ion parking that includes a quadrupole linear ion trap time-of-flight (QLITTOF) system, upon which embodiments of the present teachings may be implemented.

Numerous mass spectrometer configurations that can provide targeted ion parking based on ion mobility, ion mass, or both ion mobility and ion mass are possible. FIGS. 3-5 depict exemplary mass spectrometer configurations for targeted ion parking based on ion mass. FIGS. 6-12 depict exemplary mass spectrometer configurations for targeted ion parking based on ion mobility or both ion mobility and ion mass.

FIG. 3 is a schematic diagram that illustrates a system 300 for targeted ion parking that includes a hybrid quadrupole time-of-flight (QqTOF) mass spectrometer 320, upon which embodiments of the present teachings may be implemented. In system 300, quadrupole 150 is used to select and transmit a subset of the ionized molecules of a sample based on ion mass to quadrupole 160, where the subset of the ionized molecules is charge reduced and parked, for example. Time-of-flight (TOF) chamber 370 is used for mass analysis or fragmentation, for example.

FIG. 4 is a schematic diagram that illustrates a system 400 for targeted ion parking that includes a quadrupole linear ion trap (QLIT) mass spectrometer 420, upon which embodiments of the present teachings may be implemented. In system 400, chamber 470 is used to select and transmit a subset of the ionized molecules of a sample based on ion mass to quadrupole 140, where the subset of the ionized molecules is charge reduced and parked, for example. Linear ion trap (LIT) chamber 470 is used for mass analysis or fragmentation, for example.

In various embodiments of system 400, targeted ion parking can also be performed in chamber 470. Quadrupole 140, however, is the preferred location for ion parking, because the higher pressure of quadrupole 140 can improve efficiency and speed. System 400 is essentially a lower cost version of system 100 of FIG. 1 and can perform similar functions by manipulating ions back-and-forth between quadrupole 140 and chamber 470.

FIG. 5 is a schematic diagram that illustrates a system 500 for targeted ion parking that includes a quadrupole linear ion trap time-of-flight (QLITTOF) mass spectrometer 520, upon which embodiments of the present teachings may be implemented. In system 500, chamber 470 is used to select and transmit a subset of the ionized molecules of a sample based on ion mass to quadrupole 140, where the subset of the ionized molecules is charge reduced and parked, for example. Time-of-flight (TOF) chamber 370 is used for mass analysis or fragmentation, for example.

Figure 6:
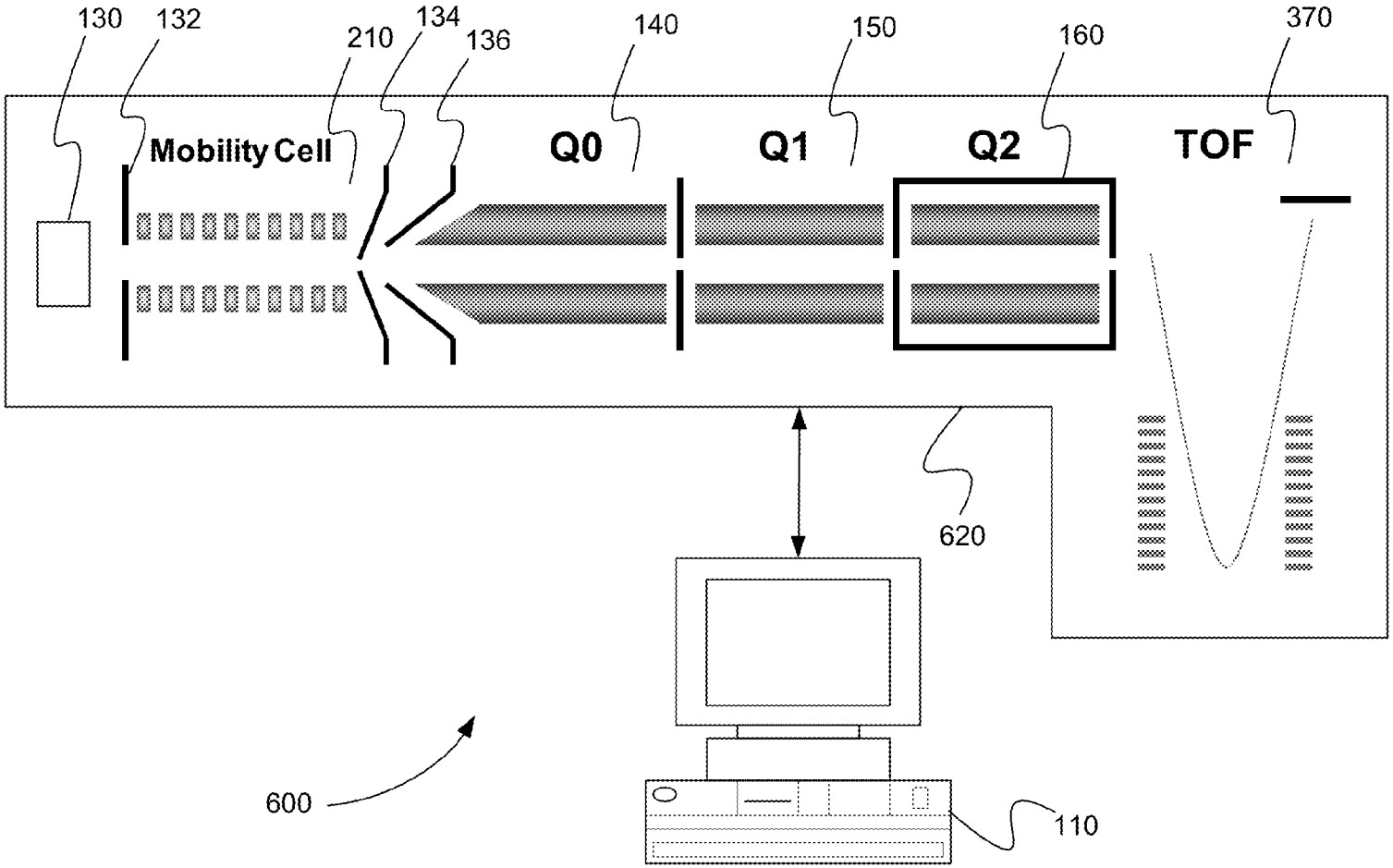
FIG. 6 is a schematic diagram that illustrates a system for targeted ion parking that includes a mobility cell and a quadrupole time-of-flight (QqTOF) system, upon which embodiments of the present teachings may be implemented.

FIG. 6 is a schematic diagram that illustrates a system 600 for targeted ion parking that includes a mobility cell and a quadrupole time-of-flight (QqTOF) mass spectrometer 620, upon which embodiments of the present teachings may be implemented. In system 600, mobility cell 210 is used to select and transmit a subset of the ionized molecules of a sample based on ion mobility. The subset of the ionized molecules is then charge reduced and parked in quadrupole 160, for example. Time-of-flight (TOF) chamber 370 is used for mass analysis or fragmentation, for example.

In various embodiments, system 600 can be used to perform targeted ion parking based on both ion mobility and ion mass. Mobility cell 210 is used to select and transmit a subset of the ionized molecules of a sample based on ion mobility. Quadrupole 150 is used to select and transmit a subset of the mobility selected ionized molecules based on ion mass to quadrupole 160, where the subset of the ionized molecules is charge reduced and parked, for example.

Figure 7:
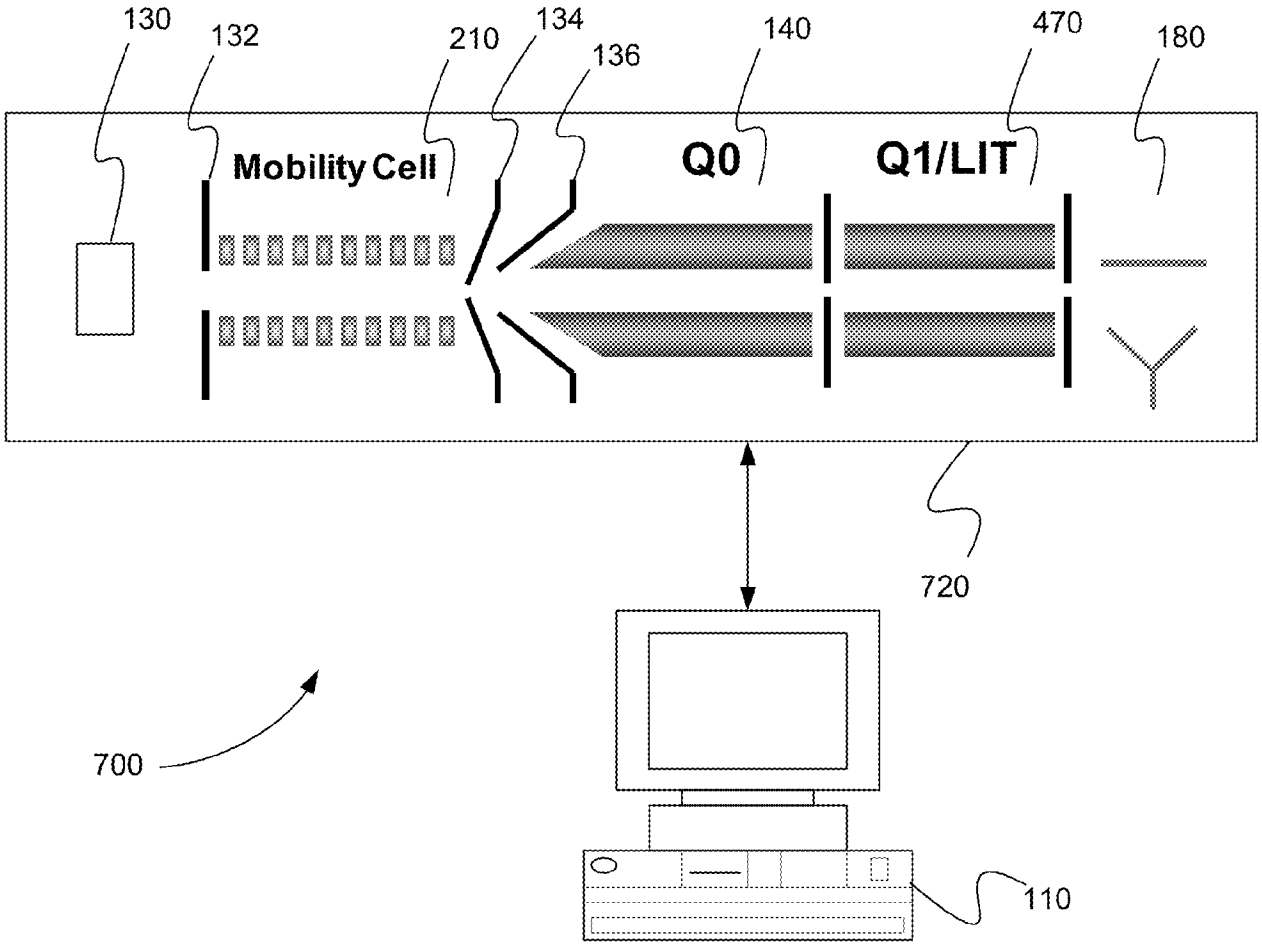
FIG. 7 is a schematic diagram that illustrates a system for targeted ion parking that includes a mobility cell and a quadrupole linear ion trap (QLIT) system, upon which embodiments of the present teachings may be implemented.

FIG. 7 is a schematic diagram that illustrates a system 700 for targeted ion parking that includes a mobility cell and a quadrupole linear ion trap (QLIT) mass spectrometer 720, upon which embodiments of the present teachings may be implemented. In system 700, mobility cell 210 is used to select and transmit a subset of the ionized molecules of a sample based on ion mobility. The subset of the ionized molecules is then charge reduced and parked in quadrupole 140, for example. Linear ion trap (LIT) chamber 470 is used for mass analysis or fragmentation, for example.

In various embodiments, system 700 can be used to perform targeted ion parking based on both ion mobility and ion mass. Mobility cell 210 is used to select and transmit a subset of the ionized molecules of a sample based on ion mobility. Chamber 470 is used to select and transmit a subset of the mobility selected ionized molecules based on ion mass to quadrupole 140, where the subset of the ionized molecules is charge reduced and parked, for example.

Figure 8:
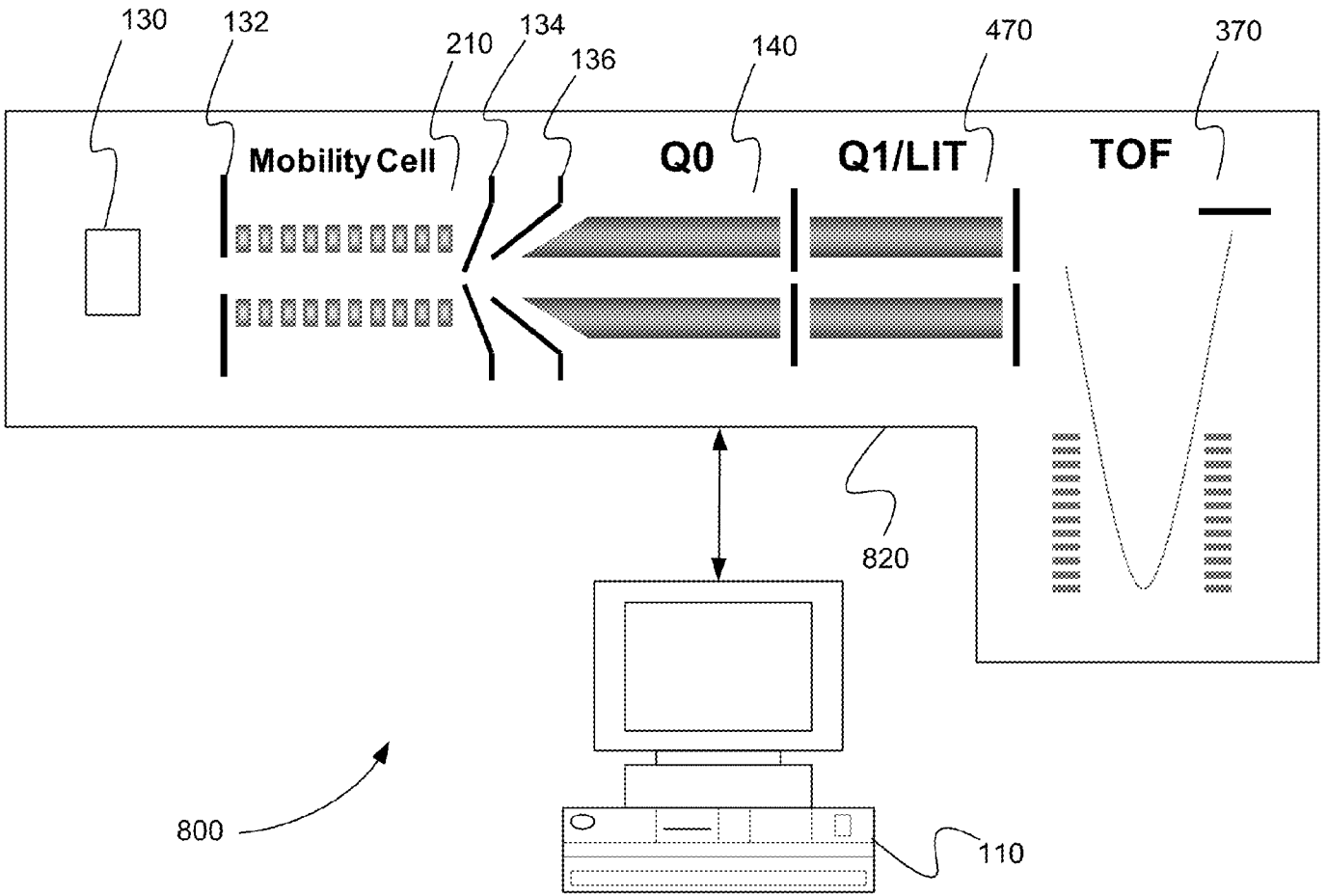
FIG. 8 is a schematic diagram that illustrates a system for targeted ion parking that includes a mobility cell and a quadrupole linear ion trap time-of-flight (QLITTOF) system, upon which embodiments of the present teachings may be implemented.

FIG. 8 is a schematic diagram that illustrates a system 800 for targeted ion parking that includes a mobility cell and a quadrupole linear ion trap time-of-flight (QLITTOF) mass spectrometer 820, upon which embodiments of the present teachings may be implemented. In system 800, mobility cell 210 is used to select and transmit a subset of the ionized molecules of a sample based on ion mobility. The subset of the ionized molecules is then charge reduced and parked in quadrupole 140, for example. Time-of-flight (TOF) chamber 370 is used for mass analysis or fragmentation, for example.

In various embodiments, system 800 can be used to perform targeted ion parking based on both ion mobility and ion mass. Mobility cell 210 is used to select and transmit a subset of the ionized molecules of a sample based on ion mobility. Chamber 470 is used to select and transmit a subset of the mobility selected ionized molecules based on ion mass to quadrupole 140, where the subset of the ionized molecules is charge reduced and parked, for example.

Figure 9:
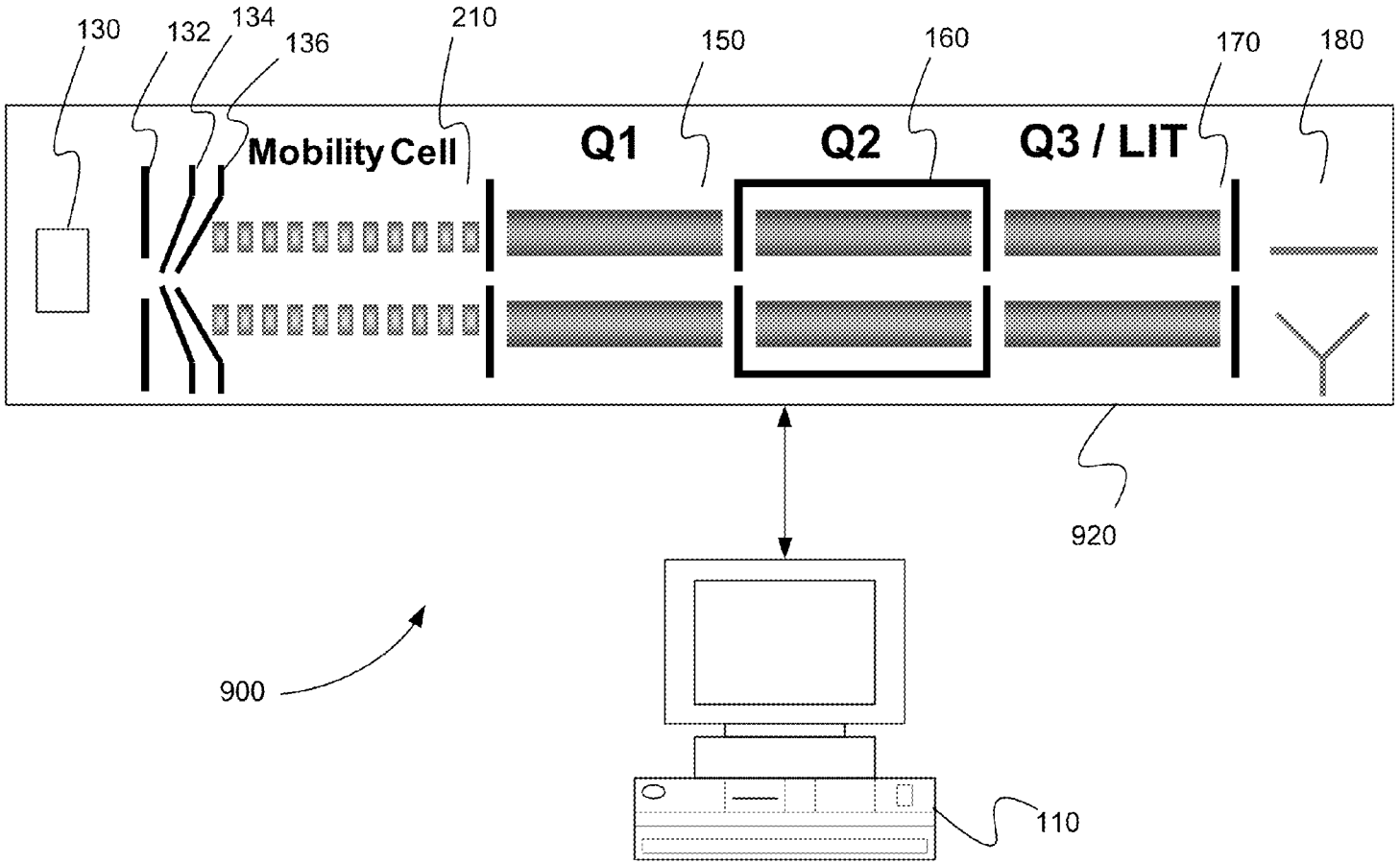
FIG. 9 is a schematic diagram that illustrates a system for targeted ion parking that includes a mobility cell and a hybrid triple quadrupole linear ion trap (QqQLIT) system, where mobility selection is performed at reduced pressure and can be performed before mass selection, upon which embodiments of the present teachings may be implemented.

FIG. 9 is a schematic diagram that illustrates a system 900 for targeted ion parking that includes a mobility cell and a hybrid quadrupole linear ion trap (QqQLIT) mass spectrometer 920, where mobility selection is performed at reduced pressure and can be performed before mass selection, upon which embodiments of the present teachings may be implemented. In system 900, mobility cell 210 is used to select and transmit a subset of the ionized molecules of a sample based on ion mobility at reduced pressure. Reduced pressure is, for example, less than one Torr. Mobility cell 210 is located between skimmer 136 and quadrupole 150. The subset of the ionized molecules is then charge reduced and parked in quadrupole 160, for example. Linear ion trap (LIT) chamber 170 is used for mass analysis or fragmentation, for example.

In various embodiments, system 900 can be used to perform targeted ion parking based on both ion mobility and ion mass. Mobility cell 210 is used to select and transmit a subset of the ionized molecules of a sample based on ion mobility. Quadrupole 150 is used to select and transmit a subset of the mobility selected ionized molecules based on ion mass to quadrupole 160, where the subset of the ionized molecules is charge reduced and parked, for example.

Figure 10:
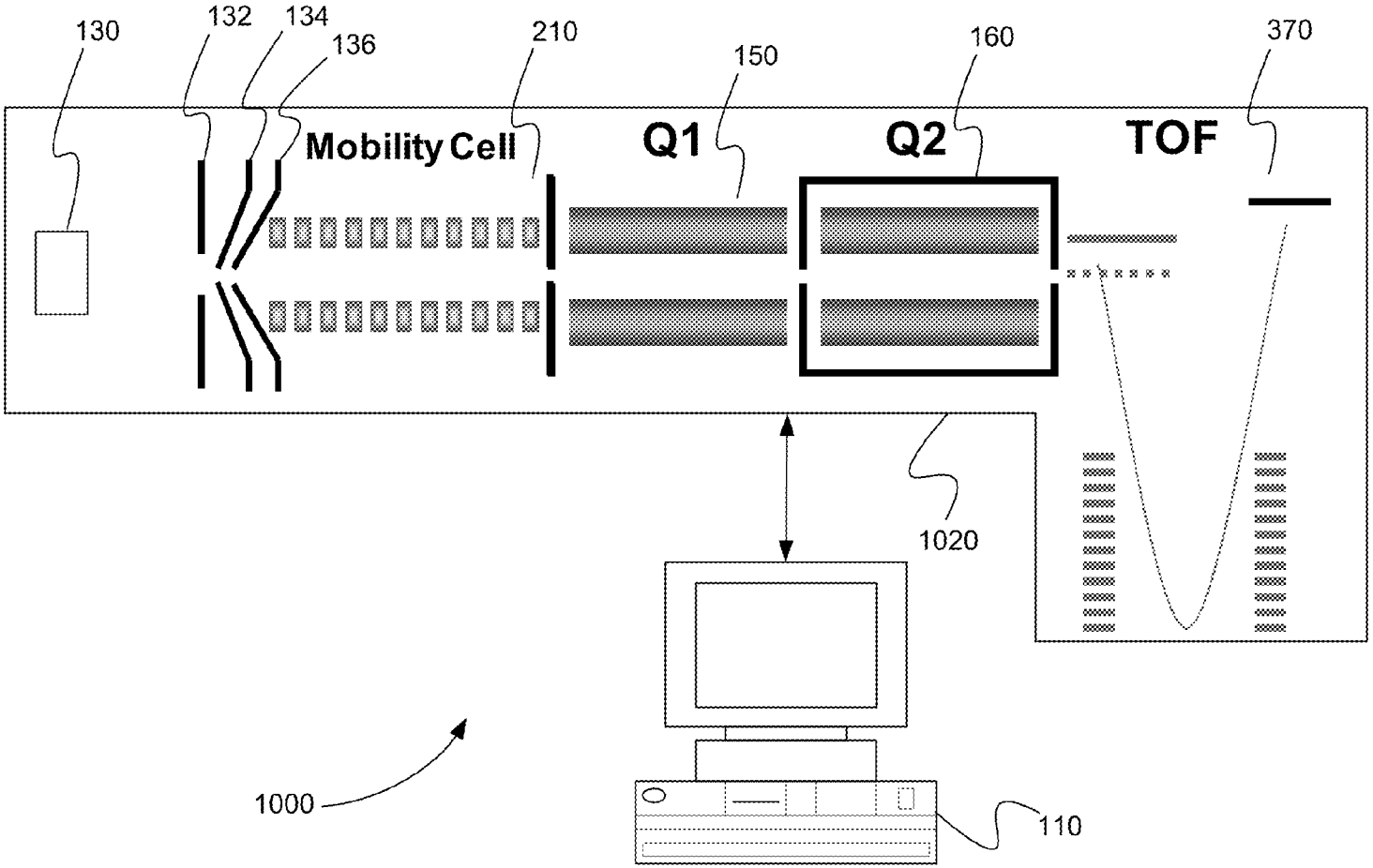
FIG. 10 is a schematic diagram that illustrates a system for targeted ion parking that includes a mobility cell and a hybrid quadrupole time-of-flight (QqTOF) system, where mobility selection is performed at reduced pressure and can be performed before mass selection, upon which embodiments of the present teachings may be implemented.

FIG. 10 is a schematic diagram that illustrates a system 1000 for targeted ion parking that includes a mobility cell and a hybrid quadrupole time-of-flight (QqTOF) mass spectrometer 1020, where mobility selection is performed at reduced pressure and can be performed before mass selection, upon which embodiments of the present teachings may be implemented. In system 1000, mobility cell 210 is used to select and transmit a subset of the ionized molecules of a sample based on ion mobility at reduced pressure. The subset of the ionized molecules is then charge reduced and parked in quadrupole 160, for example. Time-of-flight (TOF) chamber 370 is used for mass analysis or fragmentation, for example.

In various embodiments, system 1000 can be used to perform targeted ion parking based on both ion mobility and ion mass. Mobility cell 210 is used to select and transmit a subset of the ionized molecules of a sample based on ion mobility. Quadrupole 150 is used to select and transmit a subset of the mobility selected ionized molecules based on ion mass to quadrupole 160, where the subset of the ionized molecules is charge reduced and parked, for example.

Figure 11:
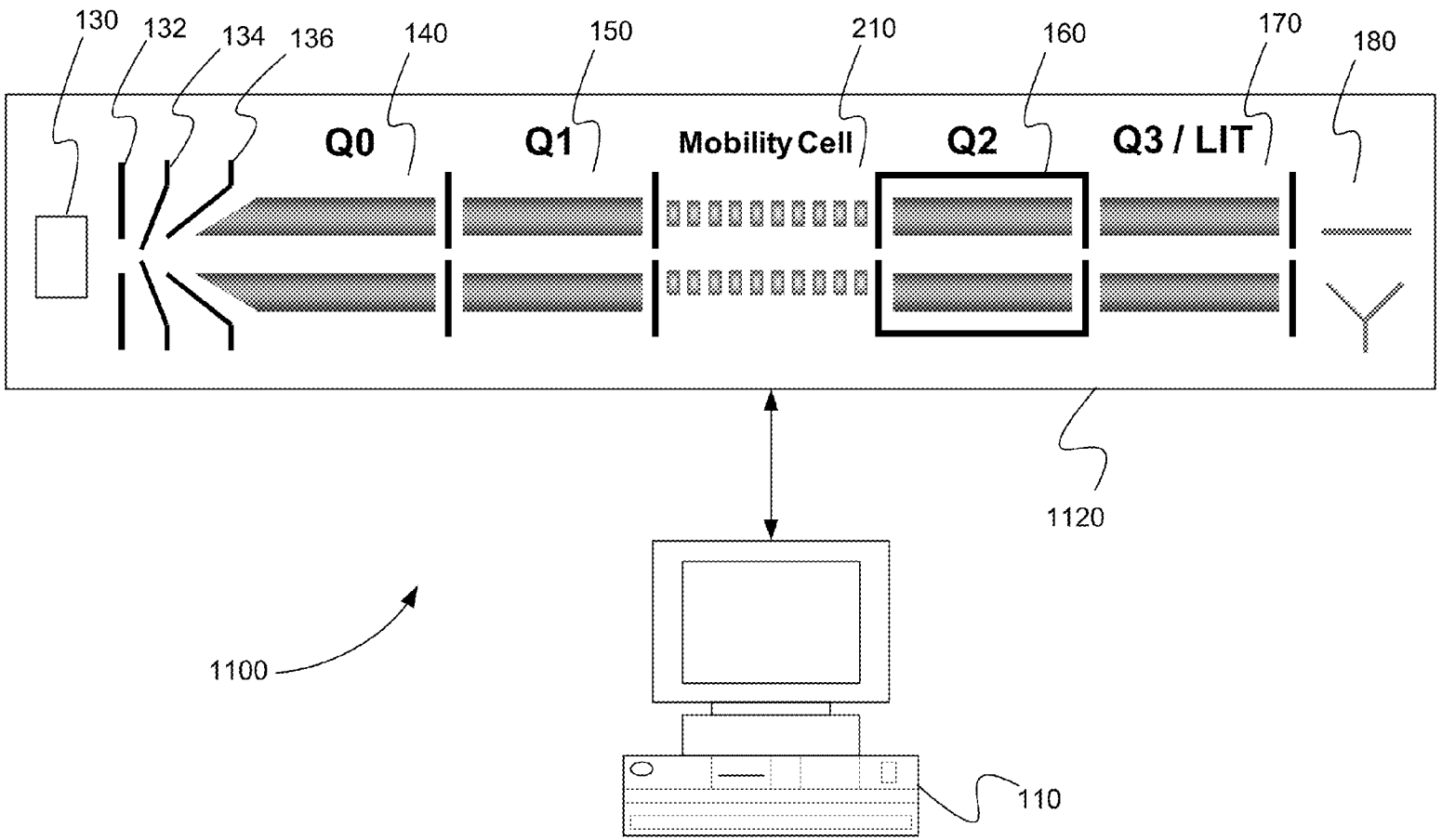
FIG. 11 is a schematic diagram that illustrates a system for targeted ion parking that includes a mobility cell and a hybrid quadrupole linear ion trap (QqQLIT) system, where mobility selection is performed at reduced pressure and can be performed after mass selection, upon which embodiments of the present teachings may be implemented.

FIG. 11 is a schematic diagram that illustrates a system 1100 for targeted ion parking that includes a mobility cell and a hybrid quadrupole linear ion trap (QqQLIT) mass spectrometer 1120, where mobility selection is performed at reduced pressure and can be performed after mass selection, upon which embodiments of the present teachings may be implemented. In system 1100, mobility cell 210 is used to select and transmit a subset of the ionized molecules of a sample based on ion mobility at reduced pressure. Mobility cell 210 is located between quadrupole 150 and quadrupole 160. The subset of the ionized molecules is then charge reduced and parked in quadrupole 160, for example. Linear ion trap (LIT) chamber 170 is used for mass analysis or fragmentation, for example.

In various embodiments, system 1100 can be used to perform targeted ion parking based on both ion mobility and ion mass. Quadrupole 150 is used to select and transmit a subset of the ionized molecules of a sample based on ion mass. Mobility cell 210 is used to select and transmit a subset of the mass selected ionized molecules based on ion mobility to quadrupole 160, where the subset of the ionized molecules is charge reduced and parked, for example.

Figure 12:
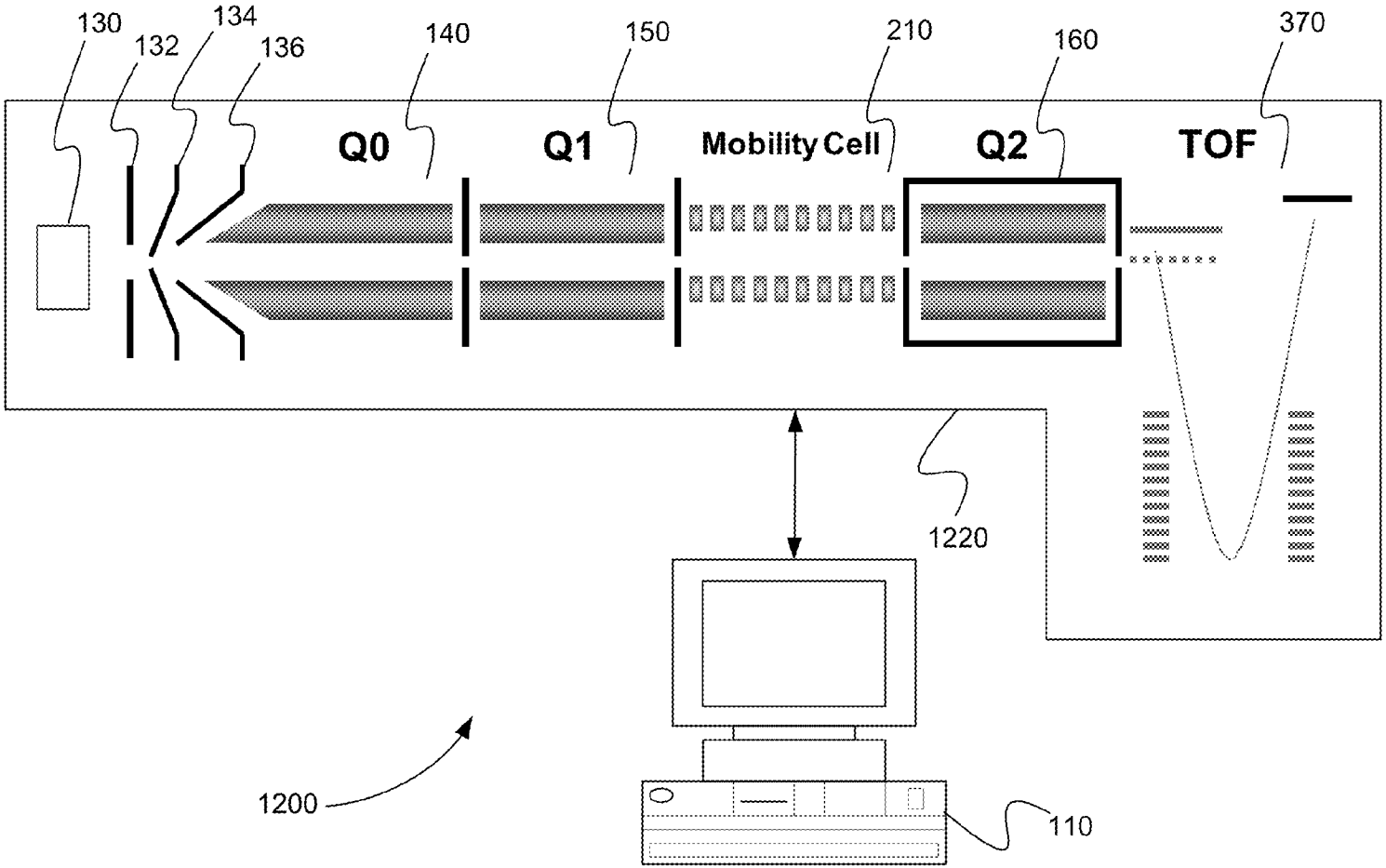
FIG. 12 is a schematic diagram that illustrates a system for targeted ion parking that includes a mobility cell and a hybrid quadrupole time-of-flight (QqTOF) system, where mobility selection is performed at reduced pressure and can be performed after mass selection, upon which embodiments of the present teachings may be implemented.

FIG. 12 is a schematic diagram that illustrates a system 1200 for targeted ion parking that includes a mobility cell and a hybrid quadrupole time-of-flight (QqTOF) mass spectrometer 1220, where mobility selection is performed at reduced pressure and can be performed after mass selection, upon which embodiments of the present teachings may be implemented. In system 1200, mobility cell 210 is used to select and transmit a subset of the ionized molecules of a sample based on ion mobility at reduced pressure. Mobility cell 210 is located between quadrupole 150 and quadrupole 160. The subset of the ionized molecules is then charge reduced and parked in quadrupole 160, for example. Time-of-flight (TOF) chamber 370 is used for mass analysis or fragmentation, for example.

In various embodiments, system 1200 can be used to perform targeted ion parking based on both ion mobility and ion mass. Quadrupole 150 is used to select and transmit a subset of the ionized molecules of a sample based on ion mass. Mobility cell 210 is used to select and transmit a subset of the mass selected ionized molecules based on ion mobility to quadrupole 160, where the subset of the ionized molecules is charge reduced and parked, for example.

Figure 13:
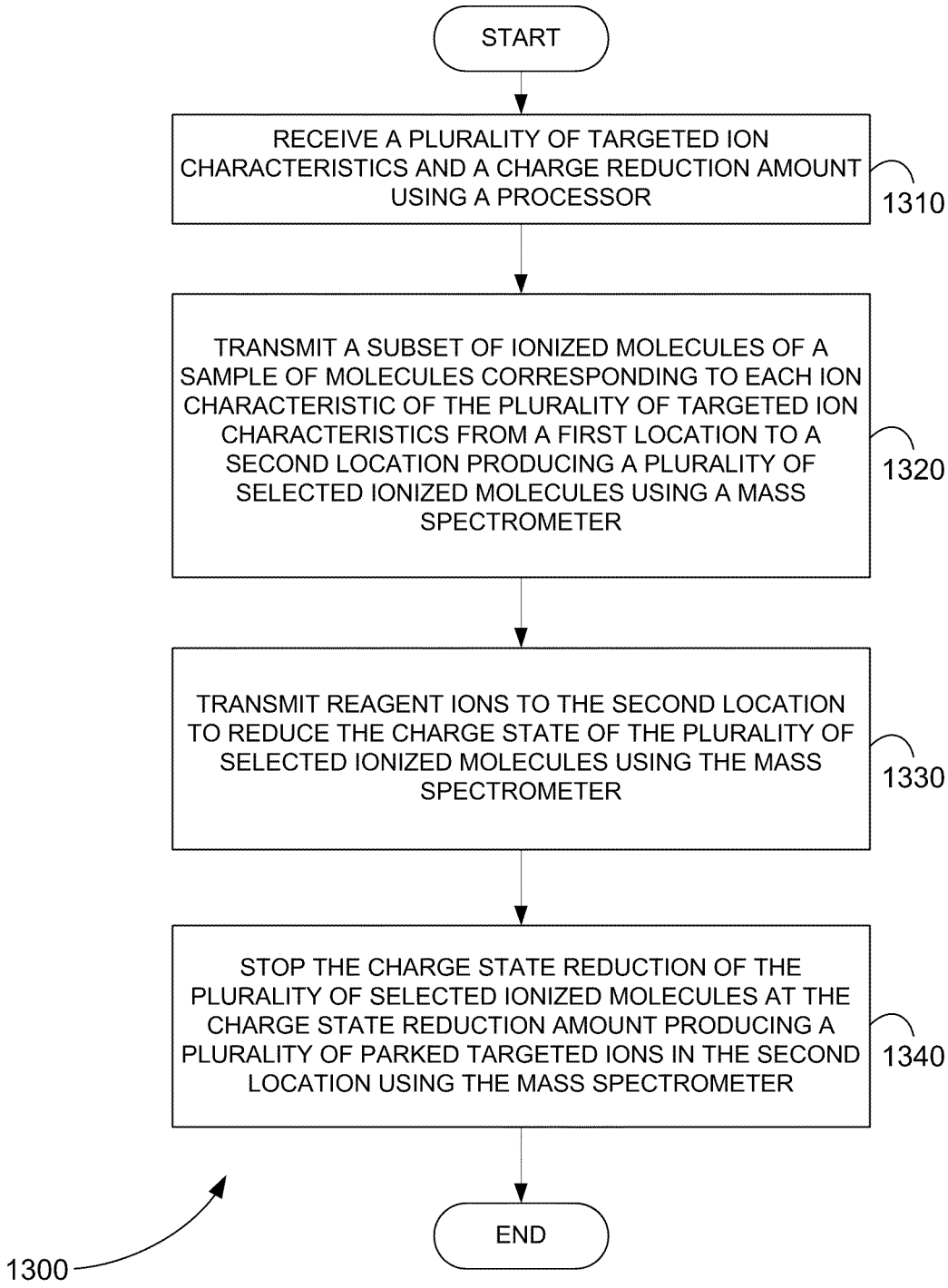
FIG. 13 is a flowchart showing a method for targeted ion parking based ion mobility or ion mass using a mass spectrometer, in accordance with the present teachings.

FIG. 13 is a flowchart showing a method 1300 for targeted ion parking based ion mobility or ion mass using a mass spectrometer, in accordance with the present teachings.

In step 1310 of method 1300, a plurality of targeted ion characteristics and a charge reduction amount are received using a processor. The plurality of targeted ion characteristics can include, but is not limited to, a plurality of targeted ion mobilities or a plurality of targeted mass-to-charge ratios.

In step 1320, a subset of ionized molecules of a sample of molecules corresponding to each ion characteristic of the plurality of targeted ion characteristics is transmitted from a first location to a second location, producing a plurality of selected ionized molecules using a mass spectrometer. If the targeted ion characteristics include a plurality of targeted ion mobilities, the first location can be a mobility cell, for example. If the targeted ion characteristics include a plurality of targeted mass-to-charge ratios, the first location can be a quadrupole, for example. If the targeted ion characteristics include a plurality of targeted mass-to-charge ratios, each subset of ionized molecules can be selected and transmitted to the second location by applying a specific RFDC voltage to the quadrupole.

In step 1330, reagent ions are transmitted to the second location to reduce the charge state of the plurality of selected ionized molecules using the mass spectrometer. The plurality of reagent ions is also transmitted from the first location to the second location, for example. A quadrupole, for example, is used to transmit the plurality of reagent ions from the first location to the second location. The second location can be, for example, a collision cell.

In step 1340, the charge state reduction of the plurality of selected ionized molecules is stopped at the charge state reduction amount, producing a plurality of parked targeted ions in the second location using the mass spectrometer. In various embodiments, the mass spectrometer of method 1300 can include, but is not limited to including, a triple quadrupole, an ion trap, or a time-of-flight spectrometer.

In various embodiments, the plurality of parked targeted ions produced in step 1340 can be used in additional ion processing. Additional ion processing can include, but is not limited to, mass analysis or fragmentation. In various embodiments, the plurality of parked targeted ions produced in step 1340 can be used for mass spectrometry mass spectrometry (MSMS). In various embodiments, the plurality of parked targeted ions produced in step 1340 can be used to identify an analyte.

In various embodiments, method 1300 can be used for quantitation. The sample of molecules described in step 1320 can include a standard group of molecules with a known concentration of an analyte. Quantitation can then be performed according to the additional following steps.

In step 1350 (not shown), a plurality of mass-to-charge ratios of the plurality of parked targeted ions found in step 1340 are detected and intensities of the plurality of mass-to-charge ratios are measured using the mass spectrometer.

In step 1360 (not shown), an additional plurality of standard groups of molecules with known concentrations of the analyte is analyzed, each standard group of the additional plurality of standard groups is used as the sample, and steps 1320-1350 are repeated for each standard group using the mass spectrometer. A calibration function is compiled that relates analyte concentration to intensities of the plurality of reduced mass-to-charge ratios using the processor.

In step 1370 (not shown), a collection of ionized molecules with an unknown concentration of the analyte is analyzed and using the collection as the sample, steps 1320-1350 are repeated using the mass spectrometer. A concentration of the analyte in the collection is determined from the measured intensities of the plurality of reduced mass-to-charge ratios and the calibration function using the processor.

The use of a mobility cell or quadrupole in method 1300 can improve the selectivity of the ionized molecules that are charge reduced in comparison to the method disclosed in the Afeyan patent, for example. Similarly, performing isolation and charge reduction in separate chambers of the mass spectrometer allows all of the charge states of the ionized molecules to be accumulated before charge reduction, thereby improving the overall throughput of method 1300 in comparison to the method disclosed in the Afeyan patent, for example.

Figure 14:
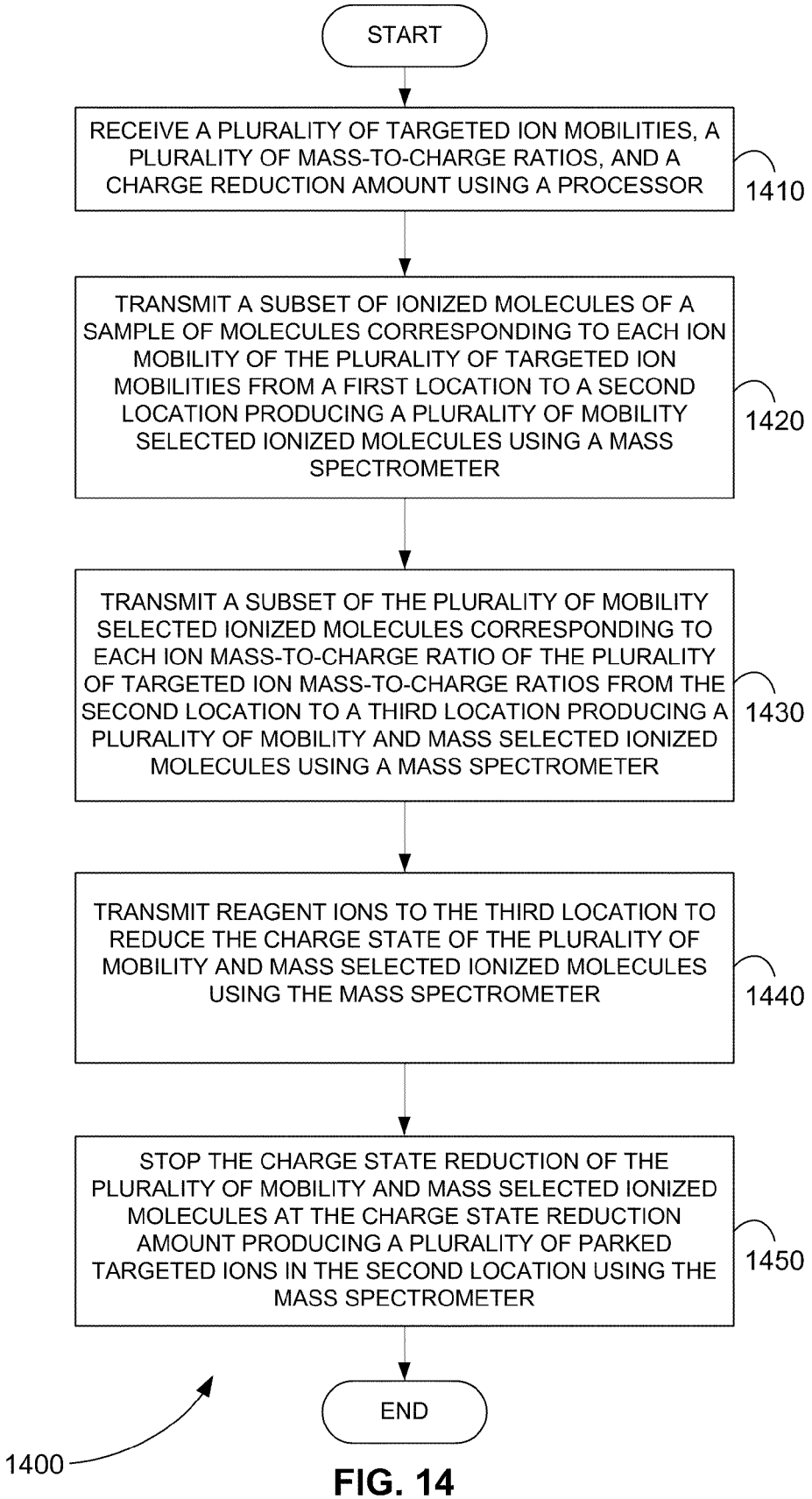
FIG. 14 is a flowchart showing a method for targeted ion parking based on ion mobility and mass selection where mobility selection is performed before mass selection using a mass spectrometer, in accordance with the present teachings.

FIG. 14 is a flowchart showing a method 1400 for targeted ion parking based on ion mobility and mass selection where mobility selection is performed before mass selection using a mass spectrometer, in accordance with the present teachings.

In step 1410 of method 1400, a plurality of targeted ion mobilities, a plurality of targeted ion mass-to-charge ratios, and a charge reduction amount are received using a processor.

In step 1420, a subset of ionized molecules of a sample of molecules corresponding to each ion mobility of the plurality of targeted ion mobilities is transmitted from a first location to a second location, producing a plurality of mobility selected ionized molecules using a mass spectrometer.

In step 1430, a subset of the plurality of mobility selected ionized molecules corresponding to each ion mass-to-charge ratio of the plurality of targeted ion mass-to-charge ratios is transmitted from the second location to a third location, producing a plurality of mobility and mass selected ionized molecules using a mass spectrometer.

In step 1440, reagent ions are transmitted to the third location to reduce the charge state of the plurality of mobility and mass selected ionized molecules using the mass spectrometer.

In step 1450, the charge state reduction of the plurality of mobility and mass selected ionized molecules is stopped at the charge state reduction amount, producing a plurality of parked targeted ions in the third location using the mass spectrometer. In various embodiments, the plurality of parked targeted ions produced in step 1450 can be used in additional ion processing. Additional ion processing can include, but is not limited to, mass analysis or fragmentation.

Figure 15:
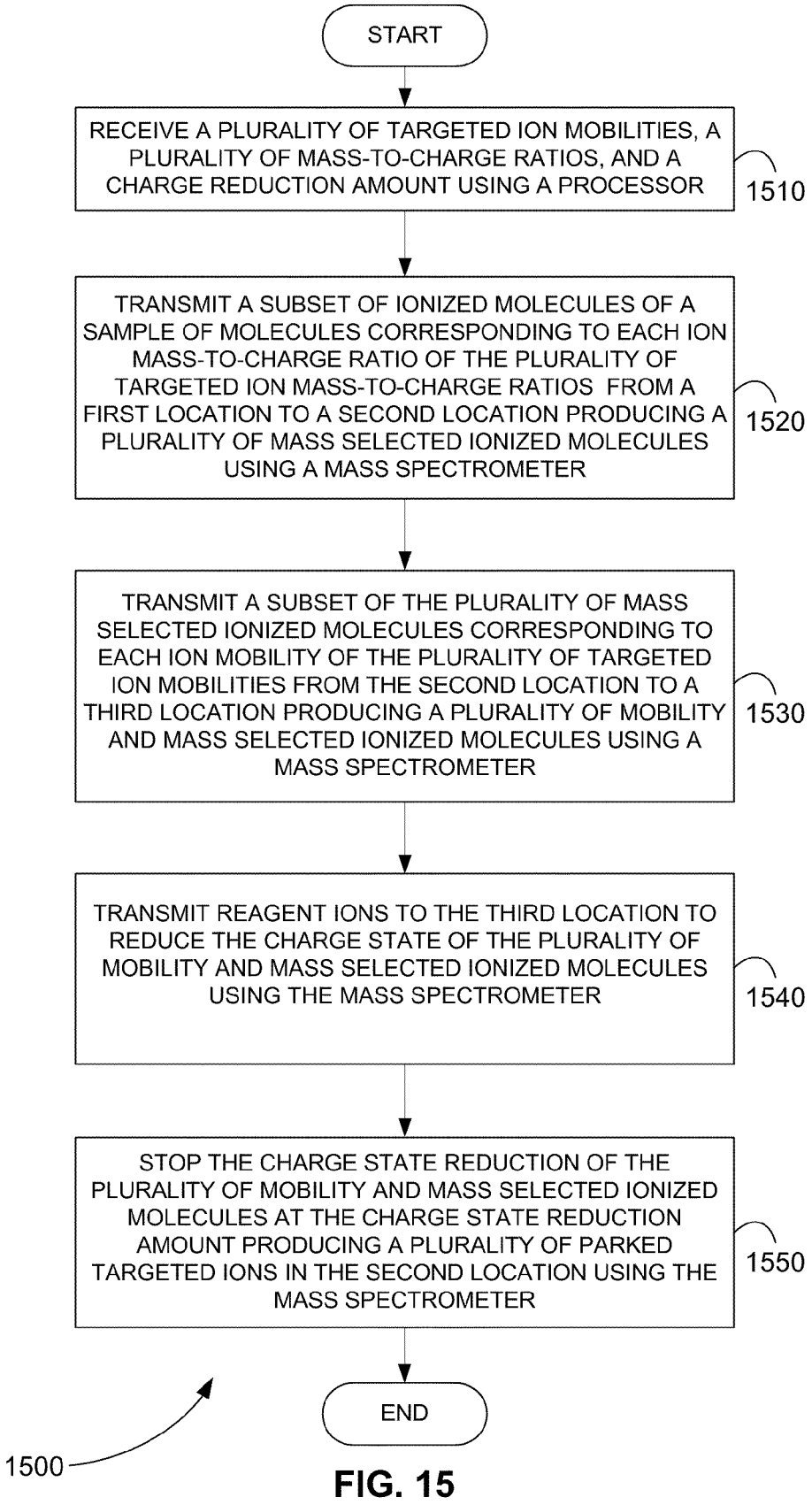
FIG. 15 is a flowchart showing a method for targeted ion parking based on ion mobility and mass selection where mass selection is performed before mobility selection using a mass spectrometer, in accordance with the present teachings.

FIG. 15 is a flowchart showing a method 1500 for targeted ion parking based on ion mobility and mass selection where mass selection is performed before mobility selection using a mass spectrometer, in accordance with the present teachings.

In step 1510 of method 1500, a plurality of targeted ion mobilities, a plurality of targeted ion mass-to-charge ratios, and a charge reduction amount are received using a processor.

In step 1520, a subset of ionized molecules of a sample of molecules corresponding to each mass-to-charge ratio of the plurality of targeted ion mass-to-charge ratios is transmitted from a first location to a second location, producing a plurality of mass selected ionized molecules using a mass spectrometer.

In step 1530, a subset of the plurality of mass selected ionized molecules corresponding to each ion mobility of the plurality of targeted ion mobilities is transmitted from the second location to a third location, producing a plurality of mobility and mass selected ionized molecules using a mass spectrometer.

In step 1540, reagent ions are transmitted to the third location to reduce the charge state of the plurality of mobility and mass selected ionized molecules using the mass spectrometer.

In step 1550, the charge state reduction of the plurality of mobility and mass selected ionized molecules is stopped at the charge state reduction amount, producing a plurality of parked targeted ions in the third location using the mass spectrometer. In various embodiments, the plurality of parked targeted ions produced in step 1550 can be used in additional ion processing. Additional ion processing can include, but is not limited to, mass analysis or fragmentation.

While the applicants' teachings are described in conjunction with various embodiments, it is not intended that the applicants' teachings be limited to such embodiments. On the contrary, the applicants' teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A method for targeted ion parking, comprising:

(a) receiving a plurality of targeted ion characteristics and a number of charges by which a plurality of selected ionized molecules are to be reduced using a processor;

(b) transmitting a subset of ionized molecules of a sample of molecules corresponding to each ion characteristic of the plurality of targeted ions characteristics from a first location to a second location, producing the plurality of selected ionized molecules using a mass spectrometer;

(c) transmitting a plurality of reagent ions to the second location to reduce a charge state of the plurality of selected ionized molecules using the mass spectrometer; and (d) stopping the charge state reduction of the plurality of selected ionized molecules at the number of charges by which the plurality of selected ionized molecules are to be reduced, producing a plurality of parked targeted ions in the second location using the mass spectrometer.

2. The method of claim 1, wherein the plurality of targeted ion characteristics comprises a plurality of ion mobilities.

3. The method of claim 2, wherein the first location comprises a mobility cell.

4. The method of claim 3, wherein the mobility cell comprises one of a differential mobility analyzer (DMA), a differential mobility spectrometry (DMS) cell, or a field asymmetric waveform ion mobility spectrometry (FAIMS) cell.

5. The method of claim 1, wherein the plurality of targeted ion characteristics comprises a plurality of ion mass-to-charge ratios.

6. The method of claim 5, wherein the first location comprises a quadrupole.

7. The method of claim 1, wherein the second location comprises a collision cell.

8. The method of claim 1, wherein the sample of molecules comprises a standard group of molecules with a known concentration of an analyte.

9. The method of claim 1, further comprising (e) detecting a plurality of mass-to-charge ratios of the plurality of parked targeted ions and measuring intensities of the plurality of mass-to-charge ratios, (f) analyzing an additional plurality of standard groups of molecules with known concentrations of the analyte, using each standard group of the additional plurality of standard groups as the sample, and repeating steps (b)-(e) for the each standard group using the mass spectrometer, and compiling a calibration function that relates analyte concentration to intensities of the plurality of reduced mass-to-charge ratios using the processor;

(g) analyzing a collection of ionized molecules with an unknown concentration of the analyte and using the collection as the sample and repeating steps (b)-(e) using the mass spectrometer, and determining a concentration of the analyte in the collection from the measured intensities of the plurality of reduced mass-to-charge ratios and the calibration function using the processor.

10. A method for targeted ion parking based on ion mobility and mass selection where mobility selection is performed before mass selection, comprising:

receiving a plurality of targeted ion mobilities, a plurality of targeted ion mass-to-charge ratios, and a number of charges by which a plurality of mobility and mass selected ionized molecules are to be reduced using a processor;

transmitting a subset of ionized molecules of a sample of molecules corresponding to each ion mobility of the plurality of targeted ion mobilities from a first location to a second location, producing a plurality of mobility selected ionized molecules using a mass spectrometer;

transmitting a subset of the plurality of mobility selected ionized molecules corresponding to each ion mass-to-charge ratio of the plurality of targeted ion mass-to-charge ratios from the second location to a third location, producing the plurality of mobility and mass selected ionized molecules using the mass spectrometer;

transmitting reagent ions to the third location to reduce the charge state of the plurality of mobility and mass selected ionized molecules using the mass spectrometer; and stopping the charge state reduction of the plurality of mobility and mass selected ionized molecules at the number of charges by which the plurality of mobility and mass selected ionized molecules are to be reduced, producing a plurality of parked targeted ions in the third location using the mass spectrometer.

11. A method for targeted ion parking based on ion mobility and mass selection where mass selection is performed before mobility selection, comprising:

receiving a plurality of targeted ion mobilities, a plurality of targeted ion mass-to-charge ratios, and a number of charges by which a plurality of mobility and mass selected ionized molecules are to be reduced using a processor;

transmitting a subset of ionized molecules of a sample of molecules corresponding to each ion mass-to-charge ratio of the plurality of targeted ion mass-to-charge ratios from a first location to a second location, producing a plurality of mass selected ionized molecules using a mass spectrometer;

transmitting a subset of the plurality of mass selected ionized molecules corresponding to each ion mobility of the plurality of targeted ion mobilities from the second location to a third location, producing the plurality of mobility and mass selected ionized molecules using the mass spectrometer;

transmitting reagent ions to the third location to reduce the charge state of the plurality of mobility and mass selected ionized molecules using the mass spectrometer; and stopping the charge state reduction of the plurality of mobility and mass selected ionized molecules at the number of charges by which the plurality of mobility and mass selected ionized molecules are to be reduced, producing a plurality of parked targeted ions in the third location using the mass spectrometer.

* * * * *